US007238121B2

(12) United States Patent
Watanabe et al.

(10) Patent No.: US 7,238,121 B2
(45) Date of Patent: Jul. 3, 2007

(54) SOLID GOLF BALL

(75) Inventors: Hideo Watanabe, Chichibu (JP); Atsuki Kasashima, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 11/225,022

(22) Filed: Sep. 14, 2005

(65) Prior Publication Data

US 2007/0060416 A1 Mar. 15, 2007

(51) Int. Cl.
*A63B 37/06* (2006.01)

(52) U.S. Cl. ..... 473/368; 473/378

(58) Field of Classification Search ..... 473/368, 473/378, 351

See application file for complete search history.

(56) References Cited

U.S. PATENT DOCUMENTS 5,368,304 A 11/1994 Sullivan et al.
6,428,428 B1 8/2002 Kuttappa et al.
6,709,348 B1 3/2004 Lemons et al.
2003/0096663 A1* 5/2003 Kasashima et al. ..... 473/371

* cited by examiner

*Primary Examiner*—Raeann Trimiew
(74) *Attorney, Agent, or Firm*—Sughrue Mion, PLLC

(57) ABSTRACT

A solid golf ball is composed of a solid core and a cover of one or more layers which encloses the core and has on a surface thereof numerous dimples. The solid core has a diameter of 38.7 to 39.6 mm and a deflection hardness of 3.0 to 4.0 mm. The cover has a Shore D hardness of 59 to 70 and has 313 to 371 dimples formed thereon. The ball has an initial velocity of at least 76.8 m/s, a coefficient of lift (CL) when hit of at least 0.165 at a Reynolds number of 70,000 and a spin rate of 2,000 rpm, and a coefficient of drag (CD) when hit of not more than 0.230 at a Reynolds number of 180,000 and a spin rate of 2,520 rpm. The golf ball has a carry which is long enough to make the ball advantageous for competitive play, in addition to which it has a good feel when hit and excellent durability to cracking with repeated impact.

5 Claims, 2 Drawing Sheets

SOLID GOLF BALL

BACKGROUND OF THE INVENTION

The present invention relates to a solid golf ball which is composed of a solid core and a cover of one or more layers that encloses the core and which has numerous dimples formed on a surface of the cover, particularly a two-piece solid golf ball composed of a solid core and a cover. More specifically, the invention relates to a solid golf ball having an excellent carry, feel on impact and durability.

Various two-piece solid golf balls in which the core diameter and deflection hardness are optimized and in which, moreover, the Shore D hardness of the cover and the diameter and depth of the dimples are optimized have been described in the prior art. Examples of such golf balls include those disclosed in U.S. Pat. No. 6,428,428, U.S. Pat. No. 6,709,348 and U.S. Pat. No. 5,368,304.

However, none of these prior-art solid golf balls have a high initial velocity and dimples that provide a low coefficient of drag at high velocity and a high coefficient of lift at low velocity. The solid golf balls disclosed in the above prior art also lack sufficient improvement in carry. There exists a need for a golf ball which is advantageous for competitive use and which provides not only an improved carry, but also has a good feel when played and retains a good durability to cracking.

SUMMARY OF THE INVENTION

The object of the invention is to provide a golf ball which, through optimization of the number of dimples, the aerodynamic properties owing to the dimples, and the cover hardness, core diameter, core hardness and ball initial velocity, has an excellent carry, feel and durability when used by the ordinary amateur golfer.

As a result of extensive investigations conducted in order to achieve the above object, we ultimately focused on the aerodynamic properties that arise from the numerous dimples formed on the surface of the cover in multi-piece golf balls of two or more pieces which are composed of a solid core and a cover of one or more layer enclosing the core. In addition, we discovered that by optimizing the deflection hardness of the core, the hardness of the cover and the Reynolds number of the ball, the internal construction of the ball (i.e., the core and cover of the ball) and the properties of the dimples on the surface of the ball serve together to confer the golf ball with properties which are beneficial overall for competitive play. That is, we have found that by giving the solid core a diameter of 38.7 to 39.6 mm and a deflection hardness (the amount of deformation when the core is subjected to loading from an initial load of 10 kgf to a final load of 130 kgf) of 3.0 to 4.0 mm, giving the cover a Shore D hardness of 59 to 70 and a number of dimples thereon of 313 to 371, and giving the ball a coefficient of lift (CL) of at least 0.165 when hit at a Reynolds number of 70,000 and a spin rate of 2,000 rpm and a coefficient of drag (CD) of not more than 0.230 when hit at a Reynolds number of 180,000 and a spin rate of 2,520 rpm, there can be obtained a golf ball advantageous for use in competitive play which has an initial velocity of at least 76.8 m/s, an increased carry, a good feel when played, and improved durability to cracking.

Accordingly, the invention provides the following golf balls.

[1] A solid golf ball composed of a solid core and a cover of one or more layers which encloses the core and has on a surface thereof numerous dimples, the solid golf ball being characterized in that the solid core has a diameter of 38.7 to 39.6 mm and a deflection hardness of 3.0 to 4.0 mm, the cover has a Shore D hardness of 59 to 70 and has 313 to 371 dimples formed thereon, and the ball has an initial velocity of at least 76.8 m/s, a coefficient of lift (CL) when hit of at least 0.165 at a Reynolds number of 70,000 and a spin rate of 2,000 rpm, and a coefficient of drag (CD) when hit of not more than 0.230 at a Reynolds number of 180,000 and a spin rate of 2,520 rpm.

[2] The solid golf ball of [1], wherein the solid core is composed primarily of cis-1,4-polybutadiene and includes from 1 to 30 parts by weight of styrene-butadiene rubber per 100 parts by weight of the polybutadiene.

[3] The solid golf ball of [1], wherein the solid core has a JIS-C hardness at the surface thereof of 78 to 85, a JIS-C hardness at the center thereof of 60 to 68, and a difference therebetween of at least 10 but not more than 19.

[4] The solid golf ball of [1], wherein the solid core is formed of a single layer or an inner/outer plurality of layers, and one or all of the core layers contains a rubber material synthesized with a rare earth catalyst or a Periodic Table group VIII metal compound catalyst.

BRIEF DESCRIPTION OF THE DIAGRAMS

DETAILED DESCRIPTION OF THE INVENTION

Figure 1:
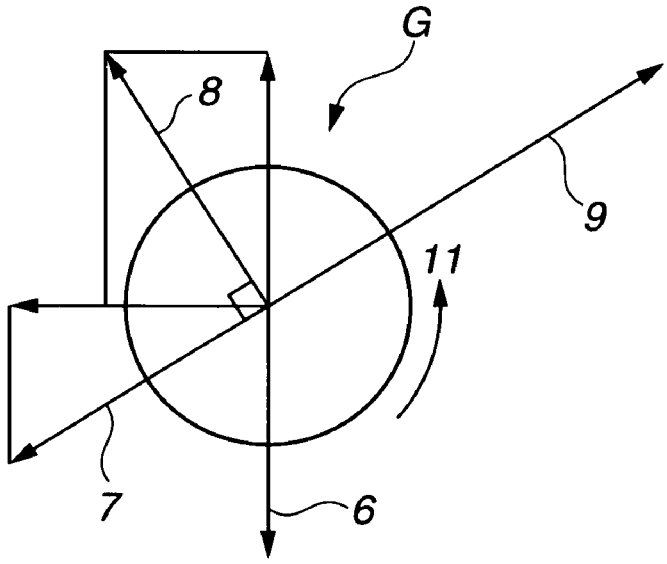
FIG. 1 is a diagram illustrating the relationship between lift and drag on a golf ball in flight.

The invention is described more fully below.

The solid golf ball of the invention is composed of a solid core and a cover of one or more layers which encloses the core. A two-piece solid golf ball is preferred.

The core has a diameter of 38.7 to 39.6 mm, preferably 38.9 to 39.5 mm, and more preferably 39.1 to 39.3 mm. A core diameter which is too small results in increased spin or a lower rebound when hit with a number one wood, preventing a sufficient carry from being achieved. On the other hand, a core diameter which is too large lowers the durability of the ball when repeatedly hit.

The core, within the above diameter range, has a compressive deflection when subjected to loading from an initial load of 10 kgf to a final load of 130 kgf ("hardness under loading from 10 kgf to 130 kgf") of at least 3.0 mm, preferably at least 3.2 mm, and more preferably at least 3.4 mm, but not more than 4.0 mm, preferably not more than 3.8 mm, and most preferably not more than 3.6 mm. If this value is too small, the feel of the ball on impact will be hard and separation of the ball from the face of the club when played will be too rapid, resulting in poor controllability. On the other hand, if the value is too large, the feel of the ball on impact will be too soft, the durability of the ball to cracking on repeated impact will worsen and the rebound will decrease, resulting in a shorter than desirable carry.

It is advantageous for the core to have a surface hardness, expressed as the JIS-C hardness, of at least 78, preferably at least 79, and more preferably at least 80, but not more than 85, preferably not more than 83, and even more preferably not more than 82. Moreover, it is advantageous for the core to have a center hardness of at least 60, preferably at least 62, and more preferably at least 63, but not more than 68, preferably not more than 66, and even more preferably not more than 65. If the core surface hardness or core center hardness is too large, the ball may have too hard a feel and separation of the ball from the face of the club when played may be too rapid. If the core surface hardness or core center hardness is too small, the ball may have too soft a feel on impact, a reduced durability to cracking with repeated impact, or a lowered rebound, resulting in a shorter than desirable carry.

In the above-described core, the JIS-C hardness value obtained by subtracting the core center hardness from the core surface hardness is typically at least 10, preferably at least 13, and more preferably at least 15, but typically not more than 19, preferably not more than 18, and more preferably not more than 17. If the value obtained by subtracting the core center hardness from the core surface hardness is too small, the spin of the ball when hit with a driver (W#1) may increase excessively, preventing the desired distance from being achieved, and the feel of the ball when a full shot is taken may be too hard. On the other hand, if the value obtained by subtracting the core center hardness from the core surface hardness is too large, the durability of the ball to cracking on repeated impact may worsen and the rebound may decrease, resulting in a shorter than desirable carry.

To achieve the desired hardness, it is important to suitably adjust in a good balance the types and amounts of ingredients compounded in the solid core. Compounding ingredients that may be used in the solid core include, but are not limited to, the known materials mentioned below.

The core in the inventive golf ball may be a single-layer core or may be a multilayer core composed of two or more layers.

The base rubber may be a known base rubber that is a natural or synthetic rubber. Specifically, it is recommended that a polybutadiene, especially a cis-1,4-polybutadiene having a cis structure content of at least 40%, be used. If desired, another type of rubber, such as natural rubber, polyisoprene rubber or styrene-butadiene rubber, may be compounded together with the above-described polybutadiene in the base rubber.

From the standpoint of manufacturing golf balls at a low cost and ensuring that the golf balls have a rebound which falls within the range specified by the R&A (Royal and Ancient Golf Club of St. Andrews) rules, it is advantageous to include in the base rubber from 1 to 30 parts by weight, preferably 2 to 20 parts by weight, and more preferably 5 to 15 parts by weight, of a styrene-butadiene rubber per 100 parts by weight of the polybutadiene rubber.

Also, from the standpoint of both cost and rebound, it is advantageous for the base rubber to be synthesized with a rare earth catalyst or a Periodic Table group VIII metal compound catalyst.

The golf ball cover has a Shore D hardness of at least 59, preferably at least 60, and more preferably at least 62, but not more than 70, preferably not more than 65, and more preferably not more than 63. If the cover is too soft, the ball may take on spin too easily or may have a poor rebound, resulting in a shorter carry, and may have a poor scuff resistance. On the other hand, if the cover is too hard, the durability of the ball to cracking with repeated impact may worsen, or the feel of the ball in the short game and when hit with a putter may worsen. The Shore D hardness of the cover refers here to the value measured with a type D durometer in accordance with ASTM D2240.

It is advantageous for the cover to have a thickness of at least 1.5 mm, preferably at least 1.6 mm, and more preferably at least 1.7 mm, but not more than 2.1 mm, preferably not more than 1.9 mm, and more preferably not more than 1.8 mm. If the cover is too thin, the durability to cracking with repeated impact may worsen and the resin may have difficulty spreading properly through the top portion of the mold during injecting molding, which can result in poor sphericity. On the other hand, if the cover is too thick, the ball may have increased spin when hit with a number one wood (W#1), which could shorten the carry, in addition to which the ball may have too hard a feel on impact.

The cover in the inventive golf ball may be composed of a single layer or may be composed of two or more layers. If the cover is composed of two or more layers, it is essential for the hardness of the outer layer and the overall thickness of the cover to fall within the above-specified ranges. The cover may be formed using a suitable known method, such as by injection-molding the cover directly over the core or by covering the core with two half-cups that have been molded beforehand as hemispherical shells then molding under applied heat and pressure.

The golf ball thus obtained can have numerous dimples formed on the surface of the cover thereof by a conventional method. After dimple formation, finishing operations such as buffing, painting and stamping can be carried out on the surface of the ball.

The meaning here of "numerous dimples" is described more fully.

The total number of dimples is at least 313, preferably at least 320, and more preferably at least 325, but not more than 371, preferably not more than 358, and even more preferably not more than 340. If the number of dimples is greater than the above range, the ball will have a low trajectory, shortening the distance of travel. On the other hand, if the number of dimples is smaller that the above range, the trajectory of the ball becomes so high as to prevent the ball from traveling a longer distance.

It is recommended that the number of dimple types be at least three, and preferably at least five, but not more than 30, and preferably not more than 20. The shape of the dimples is not subject to any particular limitation, and may be of a circular shape, any of various polygonal shapes, a dew drop shape, or an elliptical shape. Any one or combination of two or more of these shapes may be suitably used. For example, if the dimples are circular, dimples having a diameter of about 2.5 to 6.5 mm and a depth of 0.08 to 0.30 mm can be used. It is preferable for the value $V_0$ for each dimple, defined as the volume of space in the dimple below a flat plane circumscribed by the edge of the dimple divided by the volume of a cylinder whose base is the flat plane and whose height is the maximum depth of the dimple from the base, to be in a range of 0.35 to 0.80.

The dimples may be suitably selected in such a way that the proportion of the total surface area of an imaginary sphere accounted for by the combined surface area of dimple regions circumscribed by the edges of the individual dimples, sometimes referred to as the dimple surface coverage (SR) and expressed in percent, is within a range of 60 to 90%. The dimples may also be suitably selected in such a way that the proportion of the volume of an imaginary golf ball that is free of dimples accounted for by the combined volume of the dimples on the surface of the golf ball, sometimes referred to as the dimple volume occupancy (VR) and expressed in percent, is generally in a range of 0.6 to 1%. If the VR and SR values are outside of the above ranges, it may difficult to obtain a suitable trajectory and the carry of the ball may decrease.

Moreover, we have found that, to improve the carry of the ball, it is generally desirable for the ball to have a low coefficient of drag under high velocity conditions and a high coefficient of lift under low velocity conditions.

When a golf ball is hit with a club such as a driver (number one wood, W#1) for distance, a proper balance of lift and drag is desirable for achieving a good carry, particularly against a headwind, and for a good run after the ball lands on the ground. Such a balance depends on the ball construction, on the materials used in the ball, and also, in particular, on such dimple attributes as the types of dimples, total number of dimples, and the surface coverage and total volume of the dimples.

As shown in FIG. 1, a golf ball G in flight that has been hit by a club is known to incur gravity 6, air resistance (drag) 7, and also lift 8 due to the Magnus effect because the ball has spin. Also indicated in the same diagram are the direction of flight 9 and the direction 11 in which the ball G is spinning.

The forces acting upon the golf ball in this case are represented by the following trajectory equation (1).

$$F=FL+FD+Mg \quad (1)$$

where F: forces acting upon golf ball
FL: lift
FD: drag
Mg: gravity

The lift FL and drag FD in the trajectory equation (1) are given by formulas (2) and (3) below.

$$FL=0.5\times CL\times\rho\times A\times V2 \quad (2)$$

$$FD=0.5\times CD\times\rho\times A\times V2 \quad (3)$$

where CL: coefficient of lift
CD: coefficient of drag
ρ: air density
A: maximum cross-sectional surface area of golf ball
V: air velocity with respect to golf ball Decreasing the drag or the coefficient of drag CD by itself is not very effective for improving the carry of the ball. Making only the drag coefficient small will extend the position of the ball at the highest point of its trajectory, but in the low-velocity region after the highest point, the ball will drop due to insufficient lift and thus tend to lose carry.

The golf ball of the invention has a low-velocity CL, which is the coefficient of lift from the ball's trajectory just after being launched with an Ultra Ball Launcher (UBL) when measured at a Reynolds number of 70,000 and a spin rate of 2,000 rpm, of at least 0.165, preferably at least 0.170, and more preferably at least 0.180. The inventive golf ball has a high-velocity CD, which is the coefficient of drag just after launch at a Reynolds number of 180,000 and a spin rate of 2,520 rpm, of not more than 0.230, preferably not more than 0.225, and more preferably not more than 0.220. Outside of these ranges, the golf ball cannot achieve a good carry. The UBL is a device which includes two pairs of drums, one on top and one on the bottom. The drums are turned by belts across the two top drums and across the two bottom drums. The UBL inserts a golf ball between the turning drums and launches the golf ball under the desired conditions. This device is manufactured by Automated Design Corporation. A Reynolds number of 180,000 just after the ball is launched corresponds to a ball velocity of about 64 m/s, and a Reynolds number of 70,000 corresponds to a ball velocity of about 25 m/s.

The initial velocity of the ball is adjusted to at least 76.8 m/s, and preferably at least 77.0 m/s, but not more than 77.724 m/s. If the initial velocity is too low, the target distance will not be fully attainable at all head speeds. On the other hand, an initial velocity greater than the foregoing range will disqualify the ball under the standards established by the R&A (and the USGA), and render the ball ineligible for registration as an officially approved ball.

The initial velocity referred to above is measured using an initial velocity measuring apparatus of the same type as the USGA drum rotation-type initial velocity instrument approved by the R&A. The ball is temperature conditioned within this apparatus at 23±1° C. for at least 3 hours, then tested in a chamber at a room temperature of 23±2° C. The ball is hit using a 250-pound (113.4 kg) head (striking mass) at an impact velocity of 143.8 ft/s (43.83 m/s). One dozen balls are each hit four times. The time taken to traverse a distance of 6.28 ft (1.91 m) is measured and used to compute the initial velocity of the ball. This cycle is carried out over a period of about 15 minutes.

The solid golf ball of the invention can be made to conform to the Rules of Golf for use in competitive play, in which case the ball may be manufactured to a diameter which does not allow the ball pass through a ring having an inside diameter of 42.672 mm but is not more than 42.80 mm, and to a weight of generally from 45.0 to 45.93 g.

As explained above, the solid golf ball of the invention, owing to the combined effects of its internal construction, including the hardnesses of the solid core and the cover, and its aerodynamic performance based on dimples formed on its surface, has an initial velocity of at least 76.8 m/s, an increased carry, a good feel, and improved durability to cracking, making it highly beneficial for use in competitive play.

EXAMPLES

The following examples of the invention and comparative examples are provided by way of illustration and not by way of limitation.

Examples and Comparative Examples

Solid cores were fabricated in the examples of the invention and the comparative examples by using core formulations made up of the materials shown in Table 1 and carrying out vulcanization at 160° C. for 13 minutes. The golf balls in Comparative Example 3 were commercial Wilson Staff DX2 balls manufactured by Wilson Sporting Goods Co.

TABLE 1

(units: parts by weight)

| | Example | | Comparative Example | | | | | | |
|---|---|---|---|---|---|---|---|---|---|
| | 1 | 2 | 1 | 2 | 4 | 5 | 6 | 7 | 8 |
| BR[1)] | 88.3 | 88.3 | 88.3 | 88.3 | 88.3 | 88.3 | 88.3 | 88.3 | 88.3 |
| SBR[2)] | 11.7 | 11.7 | 11.7 | 11.7 | 11.7 | 11.7 | 11.7 | 11.7 | 11.7 |
| Zinc acrylate | 23 | 21 | 23 | 23 | 23 | 23 | 23 | 26.4 | 15.6 |
| Peroxide (1)[3)] | 0.6 | 0.6 | 0.6 | 0.6 | 0.6 | 0.6 | 0.6 | 0.6 | 0.6 |
| Peroxide (2)[4)] | 0.6 | 0.6 | 0.6 | 0.6 | 0.6 | 0.6 | 0.6 | 0.6 | 0.6 |
| Antioxidant[5)] | 0.1 | 0.1 | 0.1 | 0.1 | 0.1 | 0.1 | 0.1 | 0.1 | 0.1 |
| Zinc oxide | 5 | 5 | 5 | 5 | 5 | 5 | 5 | 5 | 5 |
| Barium sulfate | 17.9 | 18.8 | 17.7 | 17.7 | 17.7 | 19.8 | 16.8 | 16.4 | 21.2 |

Notes:
[1)]The butadiene rubber produced by JSR Corporation under the trade name BR730.
[2)]The styrene-butadiene rubber produced by JSR Corporation under the trade name SBR1507.
[3)]Peroxide (1) is dicumyl peroxide produced by NOF Corporation under the trade name Percumil D.
[4)]Peroxide (2) is 1,1-bis(t-butylperoxy)-3,3,5-trimethylcyclohexane produced by NOF Corporation under the trade name Perhexa 3M-40.
[5)]Produced by Ouchi Shinko Chemical Industry Co., Ltd. under the trade name Nocrac NS-6.

Next, two-piece solid golf balls were obtained by encasing the respective solid cores obtained in the examples of the invention and the comparative examples within covers of specific thicknesses composed of the cover resin compositions formulated as shown in Table 2.

TABLE 2

(units: parts by weight)

| | Example | | Comparative Example | | | | | | |
|---|---|---|---|---|---|---|---|---|---|
| | 1 | 2 | 1 | 2 | 4 | 5 | 6 | 7 | 8 |
| Himilan 1706[1)] | 50 | 50 | 50 | 50 | | 50 | 50 | 50 | 50 |
| Himilan 1605[2)] | 50 | 50 | 50 | 50 | | 50 | 50 | 50 | 50 |
| Himilan 1557[3)] | | | | | 50 | | | | |
| Himilan 1856[4)] | | | | | 50 | | | | |
| Polyethylene wax | 2 | 2 | 2 | 2 | 0 | 2 | 2 | 2 | 2 |
| Titanium oxide | 5 | 5 | 5 | 5 | 5 | 5 | 5 | 5 | 5 |
| Sheet hardness (Shore D) | 62 | 62 | 62 | 62 | 58 | 62 | 62 | 62 | 62 |

Notes:
[1)]A zinc-neutralized ionomer resin produced by DuPont-Mitsui Polychemicals Co., Ltd.
[2)]A sodium-neutralized ionomer resin produced by DuPont-Mitsui Polychemicals Co., Ltd.
[3)]A zinc-neutralized ionomer resin produced by DuPont-Mitsui Polychemicals Co., Ltd.
[4)]A sodium-neutralized ionomer resin produced by DuPont-Mitsui Polychemicals Co., Ltd.

The golf balls were measured and evaluated as described below to determine physical properties such as weight and hardness, and to assess the flight performance, feel and durability. The results are presented in Table 3.

Deflection Hardness of Entire Core and of Ball

The deflection hardness was measured as the amount of deflection by the spherical object being tested when subjected, on a hard plate, to an increase in load from an initial load state of 98 N (10 kgf) to a load of 1,275 N (130 kgf).

Core Hardness (Center and Surface)

The core surface hardness was measured in accordance with JIS K6301-1993 after setting the durometer perpendicular to the core surface (at the surface of the sphere). To measure the core center hardness, the core was cut into two and the sectioned plane of the core was leveled, following which the hardness at the center thereof was measured in accordance with JIS K6301-1993.

Initial Velocity of Ball

The initial velocity was measured using an initial velocity measuring apparatus of the same type as the USGA drum rotation-type initial velocity instrument approved by the R&A. The ball was temperature conditioned at 23±1° C. for at least 3 hours, then tested in a chamber at a room temperature of 23±2° C. The ball was hit using a 250-pound (113.4 kg) head (striking mass) at an impact velocity of 143.8 ft/s (43.83 m/s). One dozen balls were each hit four times. The time taken to traverse a distance of 6.28 ft (1.91 m) was measured and used to compute the initial velocity of the ball. This cycle was carried out over a period of about 15 minutes.

Aerodynamic Properties (Low-Velocity CL, High-Velocity CD)

The low-velocity CL was determined by calculating the coefficient of lift CL at a Reynolds number of 70,000 and a spin rate of 2,000 from the ball on its trajectory just after it has been launched with an Ultra Ball Launcher (UBL). The high-velocity CD was similarly obtained by measuring the drag coefficient at a Reynolds number of 180,000 and a spin rate of 2,520 rpm just after the ball was hit.

The UBL is a device which includes two pairs of drums, one on top and one on the bottom. The drums are turned by a belt across the two top drums and a belt across the two bottom drums. The UBL inserts a golf ball between the turning drums and launches the golf ball under the desired conditions. This device is manufactured by Automated Design Corporation.

Flight Performance

The distance traveled by the ball when hit at a head speed of 45 m/s with a golf club mounted on a swing robot was measured. The total distance was calculated as the average for ten balls. The golf club, a number one wood, was a Tour Stage X-Drive Type 300 having a loft of 9° and a shaft flex X. The flight performance was rated according to the following criteria.

Good: Total distance of travel was at least 229.0 m

NG: Total distance of travel was less than 229.0 m

Feel

Sensory evaluations were carried out with a panel of ten amateur golfers having head speeds of 42 to 48 m/s using W#1 clubs. Ratings were based on the following criteria.

Good: At least 7 of the 10 golfers thought the ball had a good feel

NG: Four or fewer of the 10 golfers thought the ball had a good feel

Durability to Repeated Impact

The number of times a golf ball can be repeatedly hit at a head speed of 45 m/s with a W#1 club mounted on a swing robot before cracks begin to form on the surface of the ball was determined. The average value for N=3 specimens was determined for the golf balls obtained in each example. The balls in the respective examples were rated as shown below relative to an arbitrary durability index of 100 for the number of times the ball in Example 2 was hit before cracks started to form on its surface.

Good: 100 or more

NG: less than 100

TABLE 3

| | | Example | | Comparative Example | | | | | | | |
|---|---|---|---|---|---|---|---|---|---|---|---|
| | | 1 | 2 | 1 | 2 | 3 | 4 | 5 | 6 | 7 | 8 |
| Core | Diameter (mm) | 39.3 | 39.3 | 39.3 | 39.3 | 39.3 | 39.3 | 38.5 | 39.8 | 39.3 | 39.3 |
| | Weight (g) | 36.9 | 36.9 | 36.9 | 36.9 | 37.3 | 36.9 | 35.0 | 38.1 | 36.9 | 36.9 |
| | Deflection hardness (mm) | 3.4 | 3.7 | 3.4 | 3.4 | 3.2 | 3.4 | 3.4 | 3.4 | 2.8 | 4.7 |
| | C hardness at core surface | 82 | 80 | 82 | 82 | 84 | 82 | 82 | 82 | 86 | 72 |
| | C hardness at core center | 65 | 63 | 65 | 65 | 65 | 65 | 65 | 65 | 66 | 55 |
| | Hardness difference: core surface - center | 17 | 17 | 17 | 17 | 19 | 17 | 17 | 17 | 20 | 17 |
| Cover | D hardness of sheet | 62 | 62 | 62 | 62 | 60 | 58 | 62 | 62 | 62 | 62 |
| | Thickness (mm) | 1.7 | 1.7 | 1.7 | 1.7 | 1.7 | 1.7 | 2.1 | 1.45 | 1.7 | 1.7 |
| Dimples | Type | I | I | II | III | — | I | I | I | I | I |
| | SR | 79.8 | 79.8 | 75.9 | 76.6 | 85.1 | 79.8 | 79.8 | 79.8 | 79.8 | 79.8 |
| | VR | 0.757 | 0.757 | 0.778 | 0.799 | 0.718 | 0.757 | 0.757 | 0.757 | 0.757 | 0.757 |
| | Volume ($mm^3$) | 308.4 | 308.4 | 317.3 | 325.7 | 292.1 | 308.4 | 308.4 | 308.4 | 308.4 | 308.4 |
| | Number of dimples | 330 | 330 | 432 | 420 | 312 | 330 | 330 | 330 | 330 | 330 |
| Ball | Diameter (mm) | 42.70 | 42.70 | 42.70 | 42.70 | 42.72 | 42.70 | 42.70 | 42.70 | 42.70 | 42.70 |
| | Weight (g) | 45.40 | 45.40 | 45.40 | 45.40 | 45.33 | 45.40 | 45.40 | 45.40 | 45.40 | 45.40 |
| | Deflection hardness (mm) | 2.9 | 3.1 | 2.9 | 2.9 | 2.9 | 3.2 | 2.7 | 3.0 | 2.5 | 3.8 |
| | Initial velocity (m/s) | 77.3 | 77.3 | 77.3 | 77.3 | 77.1 | 76.6 | 77.2 | 77.3 | 77.3 | 77.3 |
| Aerodynamic properties | Low-velocity CD | 0.233 | 0.233 | 0.233 | 0.228 | 0.232 | 0.233 | 0.233 | 0.233 | 0.233 | 0.233 |
| | Low-velocity CL | 0.191 | 0.191 | 0.154 | 0.159 | 0.161 | 0.191 | 0.191 | 0.191 | 0.191 | 0.191 |
| | High-velocity CD | 0.218 | 0.218 | 0.219 | 0.216 | 0.221 | 0.218 | 0.218 | 0.218 | 0.218 | 0.218 |
| | High-velocity CL | 0.166 | 0.166 | 0.164 | 0.163 | 0.173 | 0.166 | 0.166 | 0.166 | 0.166 | 0.166 |
| Flight | Carry (m) | 219.3 | 217.8 | 216.7 | 217.2 | 215.8 | 215.2 | 218.1 | 218.4 | 219.5 | 215.8 |
| | Total distance (m) | 230.1 | 229.4 | 228.4 | 228.3 | 223.3 | 225.3 | 228.1 | 229.5 | 231.4 | 226.9 |
| | Spin (rpm) | 2630 | 2558 | 2633 | 2635 | 2753 | 2795 | 2703 | 2628 | 2752 | 2397 |
| | Rating | good | good | NG | NG | NG | NG | NG | good | good | NG |
| Feel on impact | | good | good | good | good | good | good | good | good | NG | NG |
| Durability to cracking from repeated impact | | good | good | good | good | good | good | good | NG | good | NG |

Note:
In the case of Comparative Example 3, in which Wilson Staff DX2 balls produced by Wilson Sporting Goods Co. were used, the data shown in the table were obtained by taking the balls apart and carrying out the respective measurements.

Dimple characteristics for the balls used in the respective examples of the invention and comparative examples are presented in Table 4 below.

TABLE 4

Figure 2:
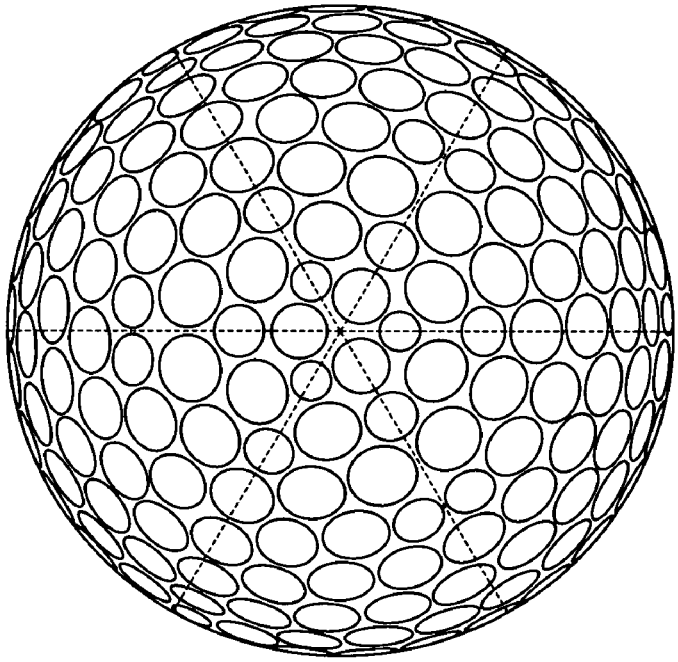
FIG. 2 is a top view of a ball showing the arrangement of dimples used in an embodiment of the invention.
Figure 3:
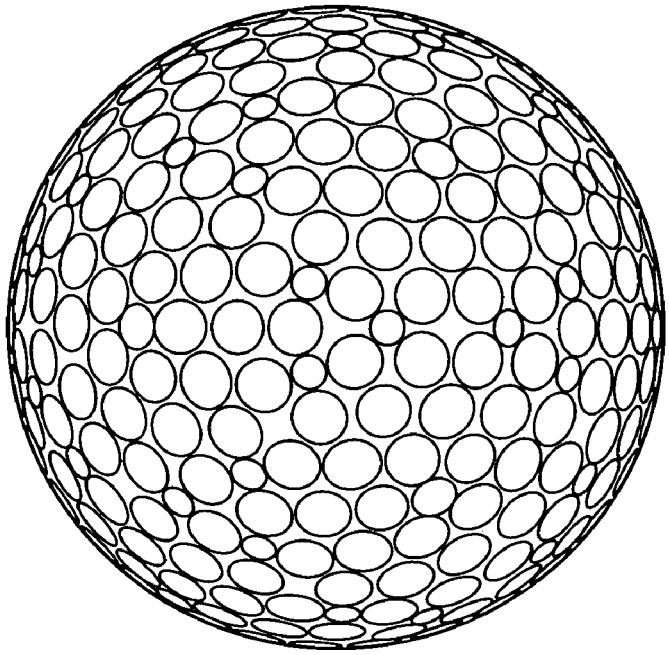
FIG. 3 is a top view of a ball showing the arrangement of dimples used in Comparative Example 1.
Figure 4:
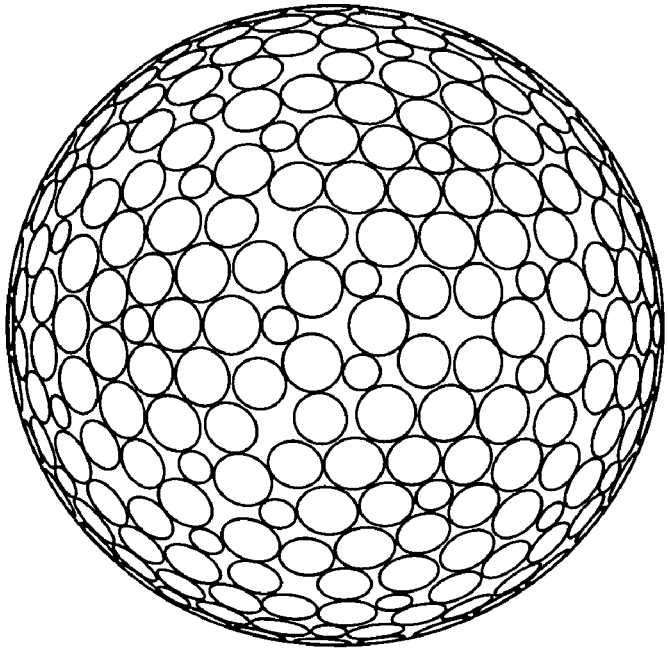
FIG. 4 is a top view of a ball showing the arrangement of dimples used in Comparative Example 2.

| | No. | Number of dimples | Diameter (mm) | Depth (mm) | $V_0$ | SR (%) | VR (%) | Total dimple volume ($mm^3$) | Dimple arrangement |
|---|---|---|---|---|---|---|---|---|---|
| I | 1 | 12 | 4.573 | 0.138 | 0.481 | 79.8 | 0.757 | 308 | FIG. 2 |
| | 2 | 198 | 4.370 | 0.135 | 0.487 | | | | |
| | 3 | 36 | 3.799 | 0.127 | 0.480 | | | | |
| | 4 | 6 | 3.450 | 0.135 | 0.472 | | | | |
| | 5 | 12 | 2.687 | 0.110 | 0.453 | | | | |
| | 6 | 36 | 4.406 | 0.171 | 0.479 | | | | |
| | 7 | 24 | 3.822 | 0.161 | 0.468 | | | | |
| | 8 | 6 | 3.278 | 0.132 | 0.460 | | | | |
| | Total | 330 | | | | | | | |
| II | 1 | 240 | 3.883 | 0.154 | 0.494 | 75.9 | 0.778 | 317 | FIG. 3 |
| | 2 | 48 | 3.310 | 0.131 | 0.483 | | | | |
| | 3 | 72 | 2.461 | 0.095 | 0.450 | | | | |
| | 4 | 42 | 3.865 | 0.172 | 0.498 | | | | |
| | 5 | 24 | 3.282 | 0.141 | 0.475 | | | | |
| | 6 | 6 | 3.391 | 0.175 | 0.502 | | | | |
| | Total | 432 | | | | | | | |
| III | 1 | 114 | 4.0268 | 0.162 | 0.474 | 76.6 | 0.799 | 326 | FIG. 4 |
| | 2 | 174 | 3.6382 | 0.147 | 0.470 | | | | |
| | 3 | 60 | 2.4872 | 0.105 | 0.430 | | | | |
| | 4 | 42 | 4.0273 | 0.195 | 0.472 | | | | |
| | 5 | 24 | 3.6148 | 0.180 | 0.466 | | | | |
| | 6 | 6 | 3.4545 | 0.219 | 0.493 | | | | |
| | Total | 420 | | | | | | | |

Dimple Definitions
Diameter: Diameter of flat plane circumscribed by edge of dimple.
Depth: Maximum depth of dimple from flat plane circumscribed by edge of dimple.
$V_0$: Value obtained by dividing spatial volume of dimple below a flat plane circumscribed by dimple edge by volume of a cylinder whose base is the flat plane and whose height is the maximum depth of dimple from the base.
SR: Ratio of the combined surface area of the dimples on the surface of the golf ball, each dimple surface area being defined by the edge of a flat plane circumscribed by the edge of the dimple, to the total surface area of the ball were the surface of the ball to be free of dimples.
VR: Ratio of the combined volume of the dimples on the surface of the golf ball, each dimple being formed below a flat plane circumscribed by the edge of the dimple, to the volume of the ball were the surface of the ball to be free of dimples.

It is apparent from the results in Table 3 that the golf balls according to Examples 1 and 2 of the invention have a sufficiently large distance of travel to be advantageous in competitive play, and moreover have a good feel when hit and an excellent durability to cracking with repeated impact.

By contrast, in Comparative Example 1, the large number of dimples and the low coefficient of lift at low velocity (Reynolds number, 70,000; spin, 2,000 rpm) resulted in a short distance of travel. In Comparative Example 2, the number of dimples was high and the coefficient of lift at low velocity (Reynolds number, 70,000; spin, 2,000 rpm) was too low, resulting in a short travel distance. In Comparative Example 3, the number of dimples was small and the coefficient of lift at low velocity (Reynolds number, 70,000; spin, 2,000 rpm) was too low, resulting in a short travel distance. In Comparative Example 4, the cover was soft and the ball had too low an initial velocity, resulting in a short distance. In Comparative Example 5, the core diameter was too small and the spin of the ball when hit with a number one wood was too high, resulting in a poor distance. In Comparative Example 6, the core diameter was too large and the cover was too thin, resulting in a poor durability to cracking with repeated impact. In Comparative Example 7, the core was too hard, giving the ball an excessively hard feel on impact. In Comparative Example 8, the core was too soft, resulting in an excessively soft feel on impact, a short travel distance and poor durability to cracking with repeated impact.

The invention claimed is:

1. A solid golf ball, comprising a solid core and a cover of one or more layers which encloses the core and has on a surface thereof numerous dimples, wherein:

the solid core has a diameter of 38.7 to 39.6 mm and a deflection hardness of 3.0 to 4.0 mm;

the cover has a Shore D hardness of 59 to 70 and has 313 to 371 dimples formed thereon;

the ball has an initial velocity of at least 76.8 m/s, a coefficient of lift (CL) when hit of at least 0.165 at a Reynolds number of 70,000 and a spin rate of 2,000 rpm, and a coefficient of drag (CD) when hit of not more than 0.230 at a Reynolds number of 180,000 and a spin rate of 2,520 rpm; and the solid core has a JIS-C hardness at the surface thereof of 78 to 85, a JIS-C hardness at the center thereof of 60 to 68, and a difference therebetween of at least 10 but not more than 19.

2. The solid golf ball of claim 1, wherein the solid core is composed primarily of cis-1,4-polybutadiene and includes from 1 to 30 parts by weight of styrene-butadiene rubber per 100 parts by weight of the polybutadiene.

3. The solid golf ball of claim 1, wherein the solid core is formed of a single layer or an inner/outer plurality of layers, and one or all of the core layers contains a rubber material synthesized with a rare earth catalyst or a Periodic Table group VIII metal compound catalyst.

4. A solid golf ball, comprising a solid core and a cover of one or more layers which encloses the core and has on a surface thereof numerous dimples, wherein:

the solid core has a diameter of 38.7 to 39.6 mm and a deflection hardness of 3.0 to 4.0 mm;

the cover has a Shore D hardness of 59 to 70 and has 313 to 371 dimples formed thereon;

the ball has an initial velocity of at least 76.8 m/s, a coefficient of lift (CL) when hit of at least 0.165 at a Reynolds number of 70,000 and a spin rate of 2,000 rpm, and a coefficient of drag (CD) when hit of not more than 0.230 at a Reynolds number of 180,000 and a spin rate of 2,520 rpm; and the solid core is formed of a single layer or an inner/outer plurality of layers, and one or all of the core layers contains a rubber material synthesized with a rare earth catalyst or a Periodic Table group VIII metal compound catalyst.

5. The solid golf ball of claim 1, wherein the solid core is composed primarily of cis-1,4-polybutadiene and includes from 1 to 30 parts by weight of styrene-butadiene rubber per 100 parts by weight of the polybutadiene.

* * * * *

UNITED STATES PATENT AND TRADEMARK OFFICE

CERTIFICATE OF CORRECTION

PATENT NO. : 7,238,121 B2
APPLICATION NO. : 11/225022
DATED : July 3, 2007
INVENTOR(S) : Hideo Watanabe and Atsuki Kasashima It is certified that error appears in the above-identified patent and that said Letters Patent is hereby corrected as shown below:

Column 14, line 8, delete "claim 1" and insert --claim 4--.

Signed and Sealed this

Eighth Day of April, 2008

JON W. DUDAS
*Director of the United States Patent and Trademark Office*